US007857589B1

(12) United States Patent
Liang

(10) Patent No.: US 7,857,589 B1
(45) Date of Patent: Dec. 28, 2010

(54) TURBINE AIRFOIL WITH NEAR-WALL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 767 days.

(21) Appl. No.: 11/903,558

(22) Filed: Sep. 21, 2007

(51) Int. Cl.
*F01D 5/08* (2006.01)

(52) U.S. Cl. ..... 416/97 R

(58) Field of Classification Search ..... 416/95, 416/97 R, 96 R, 97 A; 415/115
See application file for complete search history.

(56) References Cited

U.S. PATENT DOCUMENTS

| | | | | |
|---|---|---|---|---|
| 5,667,359 | A | 9/1997 | Huber et al. | |
| 5,702,232 | A | 12/1997 | Moore | |
| 5,720,431 | A | 2/1998 | Sellers et al. | |
| 6,247,896 | B1 | 6/2001 | Auxier et al. | |
| 6,280,140 | B1 | 8/2001 | Soechting et al. | |
| 6,379,118 | B2 * | 4/2002 | Lutum et al. | 416/97 R |
| 6,533,547 | B2 | 3/2003 | Anding et al. | |
| 6,705,831 | B2 | 3/2004 | Draper | |
| 7,416,390 | B2 * | 8/2008 | Liang | 416/97 R |
| 7,520,725 | B1 * | 4/2009 | Liang | 416/97 R |
| 7,527,474 | B1 * | 5/2009 | Liang | 416/1 |
| 7,537,431 | B1 * | 5/2009 | Liang | 416/95 |
| 7,625,179 | B2 * | 12/2009 | Cunha et al. | 416/97 R |
| 7,717,675 | B1 * | 5/2010 | Liang | 416/95 |

* cited by examiner

*Primary Examiner*—Igor Kershteyn
(74) *Attorney, Agent, or Firm*—John Ryznic

(57) ABSTRACT

A turbine airfoil having a mini-serpentine flow cooling circuit on the leading edge portion to provide both convective and film cooling for the leading edge portion. The mini-serpentine flow cooling circuits are formed as separate modules, each module including a three-pass or a five-pass serpentine flow circuit with the first leg on one side of the leading edge and the last leg on the other side of the leading edge such that the middle leg of the serpentine flow circuit for each module is located along the stagnation line of the airfoil. Film cooling holes discharge cooling air from each leg onto the airfoil surface. Each module includes a metering and impingement hole located on the bottom of the first leg to individually meter cooling air from the cooling supply cavity.

9 Claims, 4 Drawing Sheets

TURBINE AIRFOIL WITH NEAR-WALL COOLING

CROSS-REFERENCE TO RELATED APPLICATIONS

This application is related to co-pending U.S. regular application Ser. No. 11/503,549 to George Liang filed Aug. 11, 2006 and entitled TURBINE AIRFOIL WITH MINI-SERPENTINE COOLING PASSAGES; and co-pending U.S. Regular application Ser. No. 11/508,013 to George Liang filed on Aug. 21, 2006 and entitled TURBINE BLADE TIP WITH MINI-SERPENTINE COOLING CIRCUIT; and to U.S. Regular application Ser. No. 11/521,748 to George Liang filed on Sep. 15, 2006 and entitled TURBINE AIRFOIL WITH NEAR-WALL MINI-SERPENTINE LEADING EDGE COOLING PASSAGE.

BACKGROUND OF THE INVENTION

1. Field of the Invention

The present invention relates generally to fluid reaction surfaces, and more specifically to leading edge cooling of airfoils in a gas turbine engine.

2. Description of the Related Art Including Information Disclosed Under 37 CFR 1.97 and 1.98

A gas turbine engine includes a turbine section in which a high temperature gas flow passes through the rotor blades and stationary vanes or nozzles to extract energy from the flow. The efficiency of the gas turbine engine can be increased by providing a higher flow temperature into the turbine. However, the temperature is limited to the material capabilities of the parts exposed to the hot gas flow.

One method of allowing for higher turbine temperatures is to provide cooling of the first and second stages of the turbine. Complex internal cooling passages have been disclosed to provide high cooling capabilities while using lower flow volumes of cooling air. Since the cooling air used in the turbine airfoils is typically bleed off air from the compressor, using less bleed off air for cooling also increases the efficiency of the engine.

A Prior Art airfoil leading edge is cooled with backside impingement in conjunction with a showerhead film cooling and is shown in FIG. 1. The airfoil 10 includes a cooling air supply cavity 22, a metering hole 23 connecting the supply cavity 22 to an impingement cavity 24, and a plurality of impingement holes 27 to discharge cooling air to the leading edge surface of the airfoil 10. A mid-chord three-pass forward flowing serpentine cooling circuit includes a first leg channel 40, a second leg channel 36, and a third leg channel 34. Film cooling holes 35 deliver cooing air to the suction side and film cooling holes 37 deliver cooling air to the pressure side from the third leg channel 34. Turbulators 50 are positioned along the walls of the channels and cavity to promote heat transfer to the cooling air. A trailing edge cooling slots 42 and cooling air exit holes 44 discharge cooling air from the first leg channel 40 to the trailing edge of the airfoil.

The showerhead film rows are fed cooling air from a common cooling supply cavity 22 and discharged at various gas side pressures. The pressure at each of the gas side locations can vary substantially as the hot gas flow accelerates around the nose of the leading edge. The minimum pressure ratio across the showerhead holes 27 is typically set by back-flow margin requirements, and the pressure ratio (and flow) across all of the other film cooling rows becomes substantially a function of the gas-side pressure. Backflow occurs when the pressure of the hot gas flow outside the leading edge is higher than the cooling air pressure inside the cooling supply cavity 24, resulting in the hot gas flowing into the inside of the airfoil. As a result of this cooling design, the cooling flow distribution and pressure ratio across the showerhead film holes 27 for the pressure side and suction side film row is predetermined by the supply pressure.

In the prior art FIG. 1 showerhead design, cooling air is bled from the supply channel through the metering impingement holes located in the rib which is segregated by the cooling supply passage and the impingement cavity. Cooling air is impinged onto the backside of the leading edge to provide leading edge convective cooling. A showerhead is also incorporated into this type of cooling system to discharge the spent impinging cooling air to provide film cooling for the leading edge region. Although this method has been suitable to address the airfoil leading edge overall metal temperature, since both pressure and suction side are cooled with the same backside impingement and showerhead film cooling, little consideration for heat load differences between the two sides is given.

U.S. Pat. No. 7,011,502 B2 issued to Lee et al on Mar. 14, 2006 entitled THERMAL SHIELD TURBINE AIRFOIL. Discloses an airfoil with a longitudinal first inlet channel (56 in this patent) connected by a row of impingement holes (48 in this patent) to a longitudinal channel (42 in this patent), being connected by a plurality of film cooling holes (50 in this patent) to the leading edge surface of the airfoil. In the Lee et al patent, the longitudinal channel is also connected to bridge channels on the pressure side and suction sides of the longitudinal channel. Only one multi-impingement channel is used in the Lee et al invention to supply film cooling holes as opposed to the three separate multi-impingement channels of the present invention.

U.S. Pat. No. 4,859,147 issued to Hall et al on Aug. 22, 1989 entitled COOLED GAS TURBINE BLADE discloses an airfoil with a showerhead arrangement having a cooling air supply cavity (24 in this patent), an impingement cavity (28 in this patent) connected to the cooling supply cavity by three slots (26 in this patent), and three film cooling holes (30 in this patent) connected to the impingement cavity.

U.S. Pat. No. 6,379,118 B2 issued to Lutum et al on Apr. 30, 2002 entitled COOLED BLADE FOR A GAS TURBINE discloses a similar showerhead arrangement to that above of the Hall et al patent. A cooling air supply cavity (50 in this patent) is connected to an impingement cavity (47 in this patent) through two impingement cooling holes (49 in this patent), and three film cooling holes (48 in this patent) are connected to the impingement cavity. Both of the Hall et al and Lutum et al patents lack the first impingement cavity and the second impingement cavity in series, and the multi-impingement cavities of the present invention.

It is an object of the present invention to alleviate the problem associated with the turbine airfoil leading edge showerhead pressure or blowing ratio of the prior art. Another object of the present invention is to improve the efficiency of a gas turbine engine by providing improved cooling for the leading edge region of the airfoil. Another object of the present invention is to provide for a turbine airfoil with a leading edge cooling circuit that will greatly reduce the airfoil leading edge metal temperature in order to reduce the cooling flow requirement to improve the turbine efficiency.

BRIEF SUMMARY OF THE INVENTION

A turbine airfoil with a near-wall mini-serpentine leading edge cooling circuit formed as a plurality of small modules spaced along the leading edge region in a blade radial direction. Individual module design is based on the airfoil gas side pressure distribution in both chordwise and spanwise directions. In addition, each individual module can be designed based on the airfoil leading edge pressure or suction side local external heat load to achieve a desired local metal temperature. The mini-serpentine module can be designed as a single triple or 3-pass parallel flow serpentine network flowing from the pressure side to the suction side of the leading edge region, or as a 5-pass parallel flow serpentine network flowing from the pressure side to the suction side or from the suction side to the pressure side of the leading edge region. In each case, a row of modules extend along the leading edge of the airfoil. Turbulators such as rough surfaces or trip strips are also incorporated into the serpentine flow channels to enhance the internal heat transfer.

Cooling air is supplied through the airfoil mid-chord cavity, metered through the cooling feed hole to the mini-serpentine flow module. Cooling air is then serpentines through the up and down flow channels to generate high internal convective heat transfer coefficient for enhancing the leading edge region convective cooling capability. In addition to the improvements achieved on the airfoil leading edge region pressure and suction sides thermal distribution, multi-metering film cooling holes can also be incorporated into the mini-serpentine module design to enhance airfoil leading edge film cooling effectiveness.

The individual modules can be designed based on the airfoil gas side pressure distribution in both chordwise and spanwise directions. Also, each individual module can be designed based on the airfoil leading edge pressure or suction side local external heat load to achieve a desired local metal temperature.

DETAILED DESCRIPTION OF THE INVENTION

Figure 2:
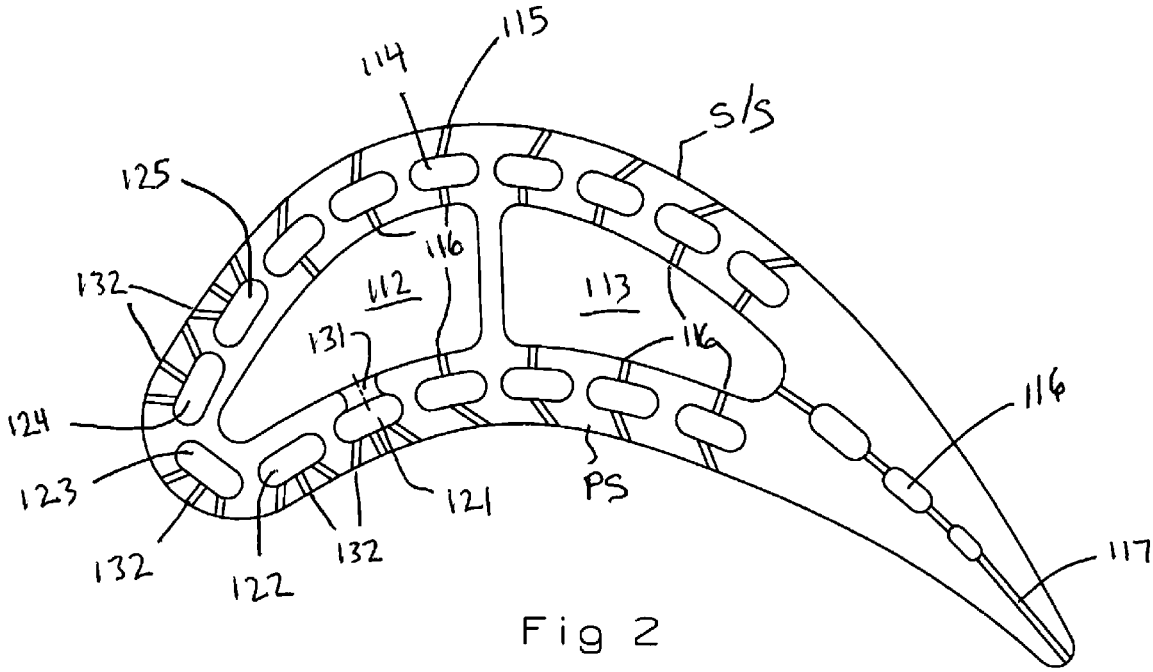
FIG. 2 shows a cross section view of a showerhead cooling circuit of the present invention first embodiment.

The near-wall mini-serpentine leading edge cooling circuit of the present invention is shown in FIG. 2. An airfoil includes a leading edge region 10, a pressure side PS and suction side SS, and a trailing edge region. Cooling supply cavities 112 and 113 supply cooling air to the various cooling circuits. Radial cooling holes 114 pass along the pressure and suction side walls of the airfoil and air connected by supply holes 116 to the cooling supply cavity 112 or 113. Film cooling holes 115 connect the radial holes 114 to the airfoil surfaces on the pressure and suction sides. The trailing edge region is cooled by three radial holes 116 connected in series to discharge cooling air through a row of exit holes 117 positioned along the trailing edge.

In the present invention, the leading edge region includes a mini-serpentine cooling module that is a 5-pass serpentine flow circuit made up of five legs or channels connected in series 121-125 in which the first leg is located on the pressure side of the leading edge region with the last leg or fifth channel located on the suction side of the leading edge. The third or middle channel 123 of the 5-pass serpentine flow circuit is located at the stagnation line along the leading edge of the airfoil. A metering and impingement hole 131 connects the 5-pass serpentine flow circuit to the cooling supply cavity 112. The metering and impingement hole 131 is connected to the bottom or upstream end of the first leg 121. Each of the parallel channels 121-125 of the serpentine flow circuit is connected with film cooling holes 131 on the surface of the pressure and suction side walls to discharge film cooling air from the serpentine channels onto the airfoil wall surface. The airfoil includes a row of these 5-pass serpentine flow modules spaced along the leading edge of the airfoil.

Figure 3:
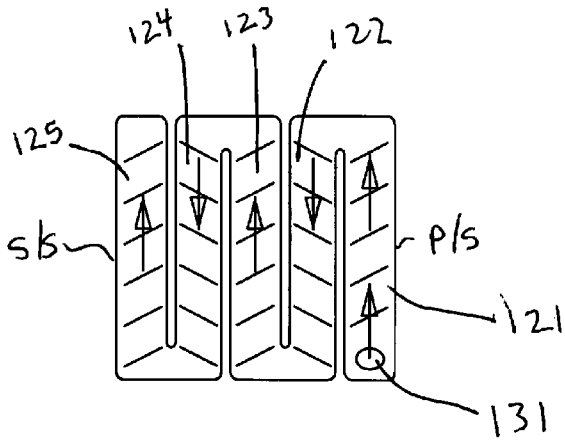
FIG. 3 shows a front view of the 5-pass mini-serpentine cooling circuit module of the present invention first embodiment.

FIG. 3 shows a front view of the mini-serpentine cooling module of the first embodiment shown in FIG. 2. The five parallel channels of the serpentine flow circuit are shown with the first leg 121 located on the pressure side and being an up-pass channel. The second leg is a down-pass channel and is also located on the pressure side. The third leg 123 is located in the middle of the serpentine circuit and along the stagnation point of the airfoil. the fourth leg is a down-pass channel and the fifth leg is an up-pas channel. Both the fourth and fifth legs 124 and 125 are located on the suction side of the airfoil.

Figure 4:
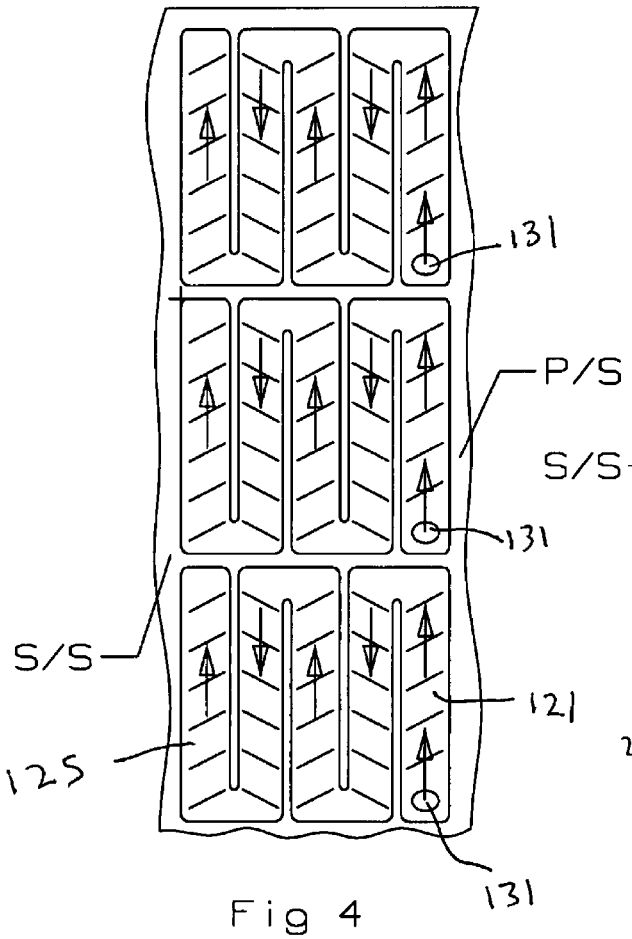
FIG. 4 shows a plurality of the mini-serpentine small modules of the first embodiment on the leading edge of an airfoil.

FIG. 4 shows a plurality of the mini-serpentine flow cooling circuit 120 positioned along the leading edge of the airfoil. In this embodiment, 3 of the modules are spaced along the airfoil in the spanwise direction. The three 5-pass serpentine flow modules each include a metering and impingement hole 131 connected to the leading edge cooling supply cavity 112, and each channel 121-125 is connected by film cooling holes 132 to discharge film cooling air onto the leading edge surface.

Figure 5:
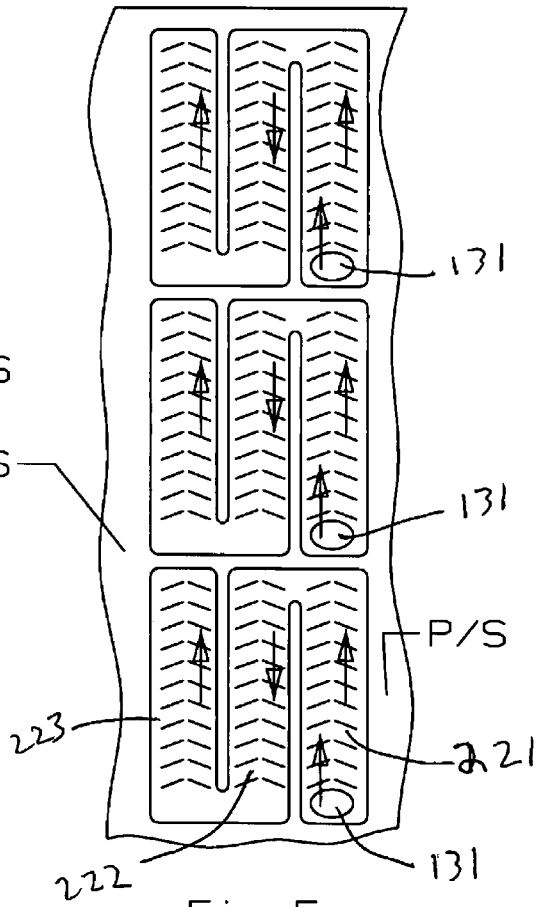
FIG. 5 shows a plurality of the triple or 3-pass mini-serpentine modules of a second embodiment of the present invention on the leading edge of an airfoil.

A second embodiment of the present invention is shown in FIG. 5. In this embodiment, instead of a 5-pass serpentine circuit a 3-pass serpentine flow circuit is used. Each module includes a 3-pass serpentine flow circuit with a first leg 221 located on the pressure side and connected by a metering and impingement hole 131 to the cooling supply cavity 112, a second leg 222 located on the stagnation line of the airfoil, and a third leg 223 located on the suction side of the airfoil. Like the first embodiment, cooling air flows through the serpentine circuit from the pressure side, across the stagnation line and to the suction side of the airfoil, discharging film cooling air along the flow.

Figure 6:
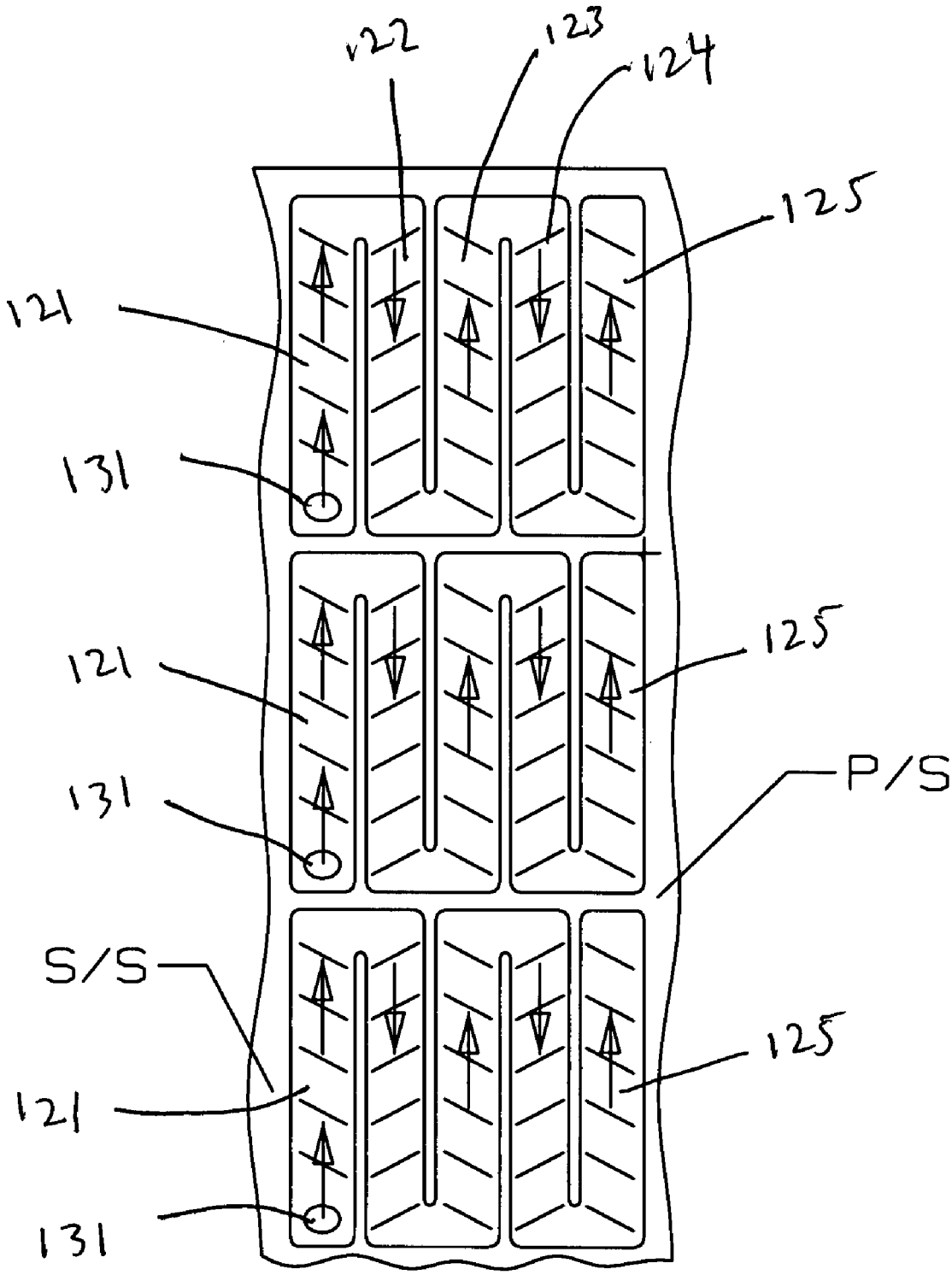
FIG. 6 shows a third embodiment of the 5-pass mini serpentine modules of the present invention with a flow direction from suction to pressure side.

A third embodiment of the present invention is shown in FIG. 6 and includes the 5-pass serpentine flow circuit of the FIG. 4 embodiment but with the flow direction from the suction side to the pressure side of the airfoil. in the FIG. 6 embodiment, the first and second legs 121 and 122 of the 5-pass serpentine flow circuit is located on the suction side, the middle or third leg 123 is located along the stagnation line, and the fourth and fifth legs 124 and 125 are located on the pressure side of the leading edge. The first leg 121 is connected to the cooling supply cavity 112 by the metering and impingement hole 131 at the bottom of the channel.

Figure 1:
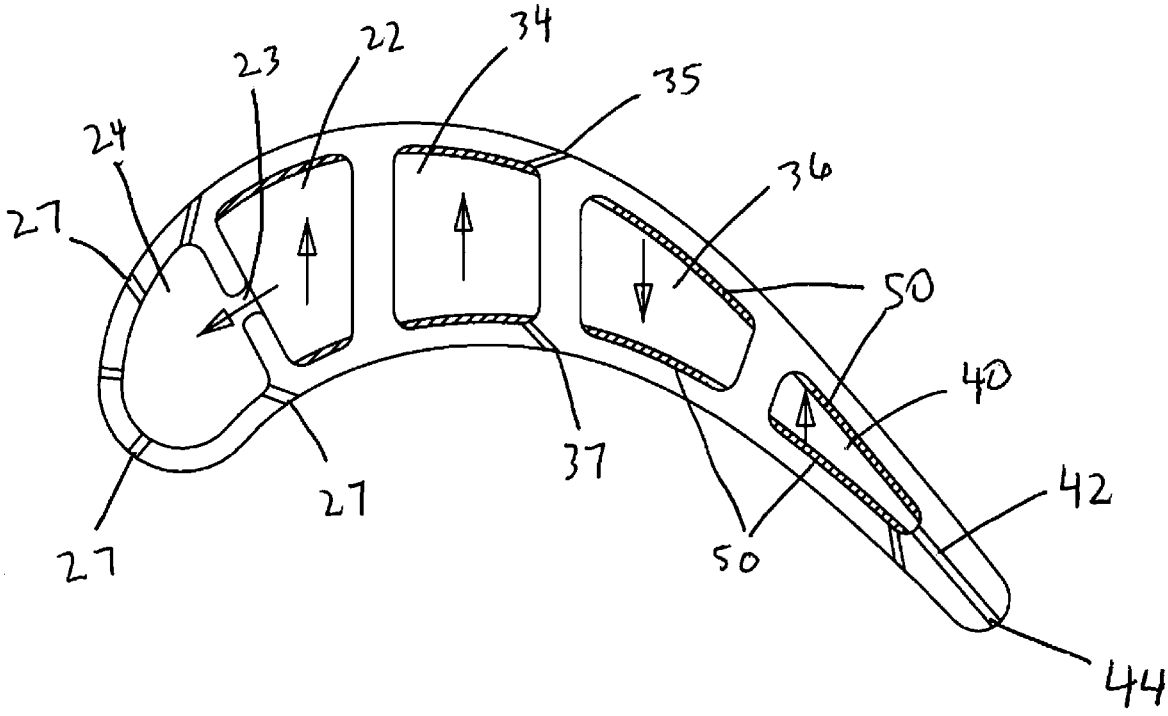
Fig 1 Prior Art
FIG. 1 shows a cross section view of a showerhead cooling circuit of the Prior Art.

In each of the three embodiments, the metering holes can be individually sized for each module in order to regulate the amount of cooling air that passes through and is discharged onto the specific leading edge airfoil location. With the unique cooling system construction of the present invention, the maximum usage of cooling air for a given airfoil inlet gas temperature and pressure profile is achieved. The combination effects for the high internal convection heat transfer coefficient generated by the multi-pass of cooling air in the serpentine channels and enhanced film cooling by the multi-holes. The overall cooling effectiveness of the cooling system of the present invention is higher than the single backside impingement with showerhead cooling design used in the prior art near wall cooling design of FIG. 1.

The multiple pass (3-pass or 5-pass) serpentine cooling circuits of the present invention can be constructed in small module formation along the leading edge of the airfoil. The individual module is designed based on the airfoil gas side pressure distribution in both the chordwise and spanwise directions of the airfoil. Also, each individual module can be designed based on the airfoil leading edge pressure or suction side local external heat load to achieve a desired local metal temperature. Cooling air is supplied through the airfoil mid-chord cavity, metered through the cooling feed hole into the multiple pass serpentine flow module. The cooling air is then serpentined through the up and down flow channels to generate a high internal convective heat transfer coefficient for enhancing the leading edge region convective cooling capacity. In addition to the improvements achieved on the airfoil leading edge region pressure and suction side thermal distribution, multi-metering film cooling holes can also be incorporated into the multiple pass serpentine module design to enhance airfoil leading edge film cooling effectiveness.

With the serpentine flow modules of the present invention, a maximum usage of cooling air for a given airfoil inlet gas temperature and pressure profile is achieved. The combination effects for the high internal convective heat transfer coefficient generated by the multiple pass of cooling air in the serpentine channels enhanced film cooling by the film discharge holes provides for the overall cooling effectiveness to be higher than in the single backside impingement with showerhead cooling design used in the prior art airfoil of FIG. 1.

The design advantages of the present invention over the prior art backside impingement with showerhead cooled blade are listed below. Each individual cooling module can be independently designed based on the local heat load and aerodynamic pressure loading conditions. Especially if multiple modules are used in the spanwise and chordwise directions for the airfoil leading edge region. The cooling design increases the design flexibility to redistribute cooling flow and/or add cooling flow to each module and therefore increase the growth potential for the cooling design for future blades that become larger and longer with increased gas flow temperature. Near wall cooling utilized for the airfoil leading edge region reduces the conduction thickness and increases airfoil overall heat transfer convection capability and therefore reduces the airfoil leading edge hot spot metal temperature which increases the airfoil anti-oxidization capability. Separation blade leading edge serpentine flow circuits eliminates flow variation within a cooling flow circuit in the blade leading edge span direction. Total leading edge film cooling air is used for backside convective cooling and then discharged as external film cooling, and thus maximizing the use of cooling air which yields the highest cooling performance available.

I claim the following:

1. A turbine airfoil having a leading edge and a trailing edge, a pressure side and a suction side, and a cooling supply cavity within the airfoil, the turbine airfoil comprising:

a plurality of serpentine flow cooling modules extending along the leading edge of the airfoil, each module comprising:

a first leg of the serpentine flow channel located on one of the pressure side or the suction side of the leading edge;

a last leg of the serpentine flow channel located on the other of the pressure side or the suction side of the leading edge;

a middle leg of the serpentine flow channel located along the stagnation line of the leading edge;

a metering and impingement hole connecting the first leg of each module to the cooling supply cavity; and, each leg in the serpentine flow cooling module including a plurality of film cooling holes to discharge film cooling air onto the respective surface of the leading edge.

2. The turbine airfoil of claim 1, and further comprising:

the first leg is located on the pressure side of the airfoil; and, the last leg is located on the suction side of the airfoil.

3. The turbine airfoil of claim 2, and further comprising:

the middle leg is a third leg of a 5-pass serpentine flow circuit; and, the last leg is the fifth leg of the 5-pass serpentine flow circuit.

4. The turbine airfoil of claim 2, and further comprising:

the middle leg is a second leg of a 3-pass serpentine flow circuit; and, the last leg is the third leg of the 3-pass serpentine flow circuit.

5. The turbine airfoil of claim 1, and further comprising:

the first leg is located on the suction side of the airfoil;

the middle leg is a third leg located along the stagnation line of the airfoil; and, the last leg is a fifth leg located on the pressure side of the airfoil.

6. The turbine airfoil of claim 1, and further comprising:

each of the channels of the serpentine flow circuits in the modules flow in the spanwise direction of the airfoil.

7. The turbine airfoil of claim 1, and further comprising:

each of the channels of the serpentine flow circuits in the modules include turbulent promotion means to increase the heat transfer coefficient.

8. The turbine airfoil of claim 1, and further comprising:

a radial extending cooling hole in the pressure side wall and a radial extending cooling hole in the suction side wall of the airfoil;

each of the radial extending cooling holes having a cooling supply hole connecting the radial extending cooling hole to the cooling supply cavity; and, each of the radial extending cooling holes having a film cooling hole to discharge film cooling air from the radial extending cooling hole onto the surface of the airfoil.

9. The turbine airfoil of claim 1, and further comprising:

the metering and impingement hole is located on the bottom of the first leg of the serpentine flow circuit in each module.

* * * * *